US008106750B2

(12) United States Patent
Cho et al.

(10) Patent No.: US 8,106,750 B2
(45) Date of Patent: Jan. 31, 2012

(54) METHOD FOR RECOGNIZING CONTROL COMMAND AND CONTROL DEVICE USING THE SAME

(75) Inventors: Jeong-mi Cho, Suwon-si (KR); Jae-won Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1238 days.

(21) Appl. No.: 11/333,321

(22) Filed: Jan. 18, 2006

(65) Prior Publication Data

US 2006/0176188 A1 Aug. 10, 2006

(30) Foreign Application Priority Data

Feb. 7, 2005 (KR) ..... 10-2005-0011426

(51) Int. Cl.
*G08C 19/00* (2006.01)

(52) U.S. Cl. ..... 340/12.5; 348/734; 367/198; 704/275

(58) Field of Classification Search ..... 340/825.69, 340/825.72, 5.84; 704/275
See application file for complete search history.

(56) References Cited

U.S. PATENT DOCUMENTS

| | | | | |
|---|---|---|---|---|
| 7,023,498 | B2 * | 4/2006 | Ishihara | 348/734 |
| 2003/0167171 | A1 * | 9/2003 | Calderone et al. | 704/270 |
| 2004/0128137 | A1 * | 7/2004 | Bush et al. | 704/275 |

FOREIGN PATENT DOCUMENTS

KR 10-2004-0025827 3/2004

OTHER PUBLICATIONS

Korean Office Action issued on Aug. 22, 2006 with respect to Korean Application No. 10-2005-0011426, which corresponds to the above-referenced application.

* cited by examiner

*Primary Examiner* — Brian Zimmerman
*Assistant Examiner* — Omer S Khan
(74) *Attorney, Agent, or Firm* — Staas & Halsey LLP

(57) ABSTRACT

A method for recognizing a control command and a control device using the same that can efficiently increase the recognition rate for a control command that includes a button input and/or speech input. The method includes receiving information input by a user; extracting a control command, which is mapped to a control object, to which a command focus is set, and the input information, with reference to predetermined reference information if the control object exists; and outputting a control signal according to the extracted control command.

14 Claims, 9 Drawing Sheets

FIG. 3

| CONTROL OBJECT | STATUS INFORMATION | EFFECTIVE INPUT | CONTROL COMMAND RECOGNITION |
|---|---|---|---|
| AIR CONDITIONER | - | NUMERAL INPUT | TEMPERATURE CONTROL |
| | | POWER ON/OFF | POWER SUPPLY/CUTOFF |
| TV | - | NUMERAL INPUT | CHANNEL CONTROL |
| | | POWER ON/OFF | POWER SUPPLY/CUTOFF |
| SLEEP TIMER | TV : ON | NUMERAL INPUT | SLEEP TIME SET |
| - | AIR CONDITIONER : ON | NUMERAL INPUT | TEMPERATURE CONTROL |

FIG. 4

| CONTROL OBJECT | EFFECTIVE INPUT | CONTROL COMMAND RECOGNITION |
|---|---|---|
| TV | VOLUME UP/DOWN, POWER ON/OFF, NUMERAL··· | VOLUME LEVEL CONTROL OF TV |
| AUDIO SYSTEM | | VOLUME LEVEL CONTROL OF AUDIO SYSTEM |

FIG. 5

| CONTROL OBJECT | EFFECTIVE INPUT | CONTROL COMMAND RECOGNITION |
|---|---|---|
| VOLUME LEVEL | NUMERAL INPUT | VOLUME LEVEL CONTROL OF TV |
| LOCKING FUNCTION | NUMERAL INPUT | PASSWORD INPUT |

FIG. 6

| CONTROL OBJECT | STATUS INFORMATION | EFFECTIVE INPUT | CONTROL COMMAND RECOGNITION |
|---|---|---|---|
| - | TV : ON | NUMERAL INPUT | CHANNEL SELECTION |
| - | AIR CONDITIONER : ON | NUMERAL INPUT | TEMPERATURE CONTROL |

FIG. 7

| CONTROL OBJECT | STATUS INFORMATION | EFFECTIVE INPUT | CONTROL COMMAND RECOGNITION |
|---|---|---|---|
| DUAL SCREEN | MAIN PICTURE: DVD, SUB-PICTURE: TV | CHANNEL UP/DOWN, POSITION INPUT | SUB-PICTURE CHANNEL CONTROL |

FIG. 8

| CONTROL OBJECT | EFFECTIVE INPUT | CONTROL COMMAND RECOGNITION |
|---|---|---|
| SLEEP TIMER | NUMERAL (AS UNIT OF 30MIN.) | VOLUME LEVEL CONTROL OF TV |

FIG. 9

| INPUT INFORMATION | CONTROL OBJECT MAPPED ON INPUT INFORMATION |
|---|---|
| "AIR CONDITIONER" | AIR CONDITIONER |
| "VOLUME" | VOLUME CONTROL |
| "DUAL SCREEN" | TV DUAL SCREEN |
| "EPG RECORDING" | PRESERVED RECORDING USING EPG |

FIG. 13

| INPUT INFORMATION | CONTROL OBJECT MAPPED ON INPUT INFORMATION |
|---|---|
| "AIR CONDITIONER" | AIR CONDITIONER |
| "TV" | TV |
| "SLEEP TIMER" | SLEEP TIMER FUNCTION OF TV |
| "SCREEN SHARPNESS" | SCREEN SHARPNESS CONTROL FUNCTION |

METHOD FOR RECOGNIZING CONTROL COMMAND AND CONTROL DEVICE USING THE SAME

CROSS-REFERENCE TO RELATED APPLICATION

This application claims benefit from Korean Patent Application No. 10-2005-0011426 filed on Feb. 7, 2005 in the Korean Intellectual Property Office, the disclosure of which is incorporated herein by reference in its entirety.

BACKGROUND OF THE INVENTION

1. Field of the Invention

The present invention relates to a method for recognizing a control command and a control device using the same, and more particularly, to a method for recognizing a control command and a control device using the same that can recognize a user's intention for a control command by using reference information.

2. Description of the Related Art

The majority of recently released home appliances can be remotely controlled by remote controllers. If a user intends to control a home appliance using a remoter controller, he/she manipulates a button or switches of the remote controller.

The functions of early remote controllers were very simple. However, as home networking and the digitalization of home appliances have developed, the functions of remote controllers have become diverse and complicated. Accordingly, the number of buttons provided on the remote controller has increased, or multistage menu navigation is required in order to control predetermined functions. It takes a lot of time for the user to understand such functions of the remote controller. In addition, although the user masters the functions of the remoter controller, he/she cannot make full use of the functions of the remote controller because the manipulation process for controlling the respective functions is complicated. Specially, as a plurality of home appliances can be controlled by a single remote controller due to the development of home network technology, the problem described above has become greater.

In order to remove this inconvenience, a remote controller that can recognize a user's speech input has recently been developed. This remote controller performs a control operation after analyzing the user's speech input.

However, according to a conventional speech-recognition remote controller, it is difficult to achieve a complex application of a speech input and a button input because the speech input and the button input are performed in a separate manner. If a button input is inputted while speech is inputted or if the speech is inputted while the button input is inputted, the remote controller may not accurately recognize the control operation intended by the user. Also, since all control commands are limited to being input through speech input, it causes inconvenience for a user when he/she wants to control functions that are difficult to be controlled via speech input or functions that can be intuitively controlled through the button input rather than through the speech input (e.g., functions that should be finely and continuously adjusted such as a brightness control).

In addition, another type of a conventional speech-recognition remote controller has been introduced that maps speech to buttons in a one-to-one manner. Accordingly, the conventional remote controller cannot remove the inconvenience that the user must navigate the multistage menu process in order to control specific functions.

SUMMARY OF THE INVENTION

Additional aspects and/or advantages of the invention will be set forth in part in the description which follows and, in part, will be apparent from the description, or may be learned by practice of the invention.

Accordingly, the present invention has been made to solve the above-mentioned problems occurring in the prior art, and an object of the present invention is to provide a method for recognizing a control command and a control device using the same which can efficiently increase the recognition rate for a control command inputted through a complex use of speech and buttons.

Additional advantages, objects, and features of the invention will be set forth in part in the description which follows and in part will become apparent to those having ordinary skill in the art upon examination of the following or may be learned from practice of the invention.

In order to accomplish these objects, there is provided a method for recognizing a control command, according to an embodiment of the present invention, which includes receiving an input information from a user; extracting a control command, which is mapped on a control object to which a command focus is set and the input information, with reference to predetermined reference information if the control object to which the command focus is set exists; and outputting a control signal according to the extracted control command.

In another aspect of the present invention, there is provided a control device which comprises a recognition unit which is configured to extract a control command, which is mapped on a control object to which a command focus is set and input information from a user, with reference to predetermined reference information if the control object to which the command focus is set exists; and a control signal generation unit which is configured to generate a control signal according to the extracted control command.

BRIEF DESCRIPTION OF THE DRAWINGS

The above and other objects, features and advantages of the present invention will become more apparent from the following detailed description taken in conjunction with the accompanying drawings, in which:

FIG. 3 is a view illustrating reference information according to an exemplary embodiment of the present invention;

FIG. 4 is a view illustrating reference information according to another embodiment of the present invention;

FIG. 5 is a view illustrating reference information according to still another embodiment of the present invention;

FIG. 6 is a view illustrating reference information according to still another embodiment of the present invention;

FIG. 7 is a view illustrating reference information according to still another embodiment of the present invention;

FIG. 8 is a view illustrating reference information according to still another embodiment of the present invention;

FIG. 9 is a view illustrating information on control objects recognizable through input information according to an exemplary embodiment of the present invention;

FIG. 13 is a view illustrating information on control objects recognizable through input information according to another embodiment of the present invention.

DETAILED DESCRIPTION OF THE PREFERRED EMBODIMENTS

Figure 1:
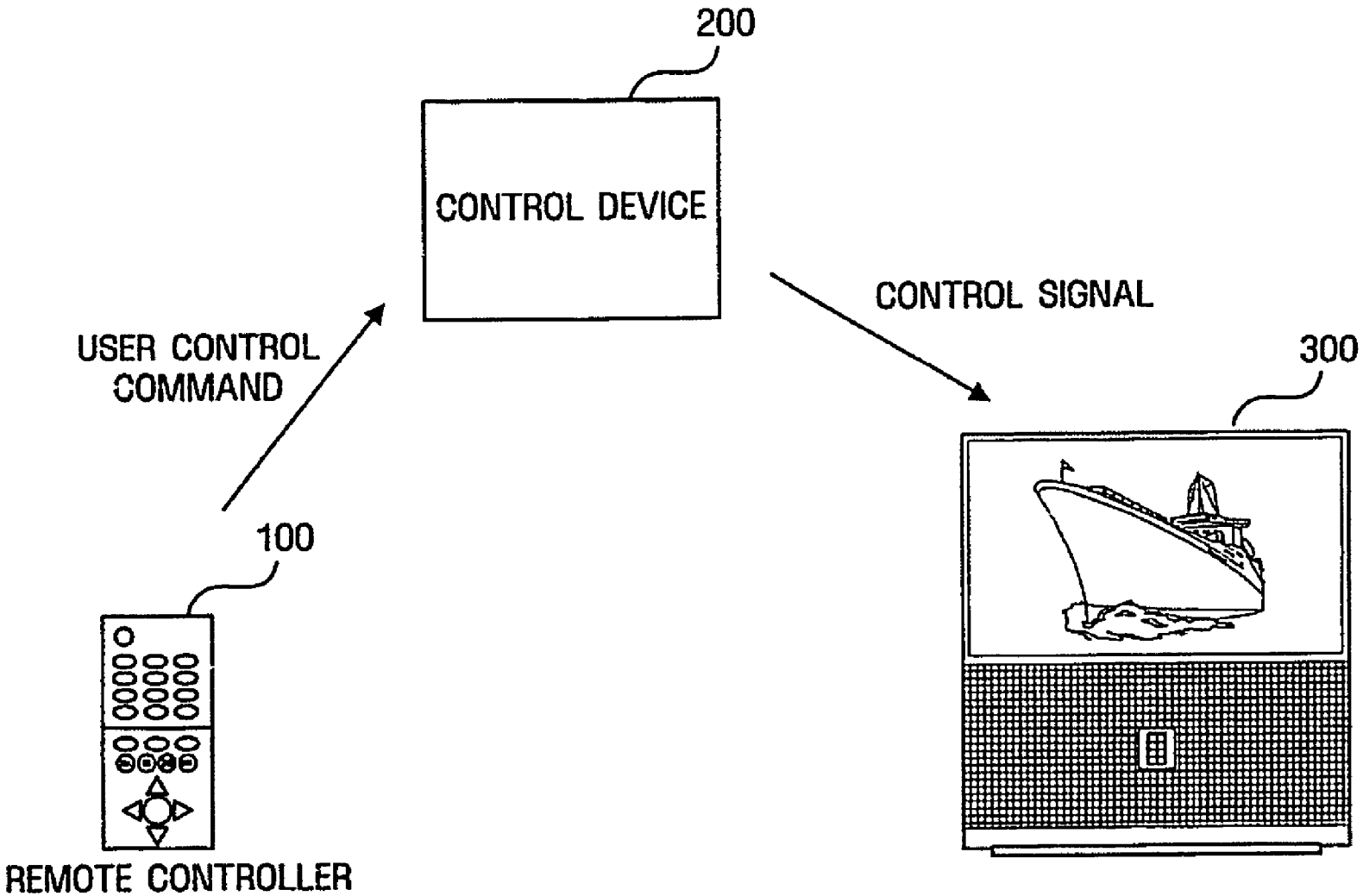
FIG. 1 is a view illustrating a control system according to an exemplary embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Hereinafter, preferred embodiments of the present invention will be described in detail with reference to the accompanying drawings. The aspects and features of the present invention and methods for achieving the aspects and features will be apparent by referring to the embodiments to be described in detail with reference to the accompanying drawings. However, the present invention is not limited to the embodiments disclosed hereinafter, but can be implemented in diverse forms. The matters defined in the description, such as the detailed construction and elements, are nothing but specific details provided to assist those of ordinary skill in the art in a comprehensive understanding of the invention, and the present invention is only defined within the scope of the appended claims. In the entire description of the present invention, the same drawing reference numerals are used for the same elements across various figures.

FIG. 1 shows a control system according to an exemplary embodiment of the present invention.

The control system may include a remote controller 100, a control device 200, and a controlled device 300. The remote controller 100, the control device 200 and the controlled device 300 can be connected by wires or they can be connected wirelessly. However, it is preferable that they be connected wirelessly.

A user can input information using the remote controller 100. In order to receive the input information from the user, the remote controller 100 may include manual input devices such as a keypad, a touch pad, or a touch screen, and/or a speech input devices such as a microphone. Hereinafter, the manual input unit included in the remote controller 100 will be called a button. A user can input the information by manipulating one of the buttons provided on the remote controller 100, or by using speech. Information input using the button is referred to as button input, and information input using speech is referred to as speech input.

The remote controller 100 transmits the information inputted by the user to the control device 200. If the input information is speech, the remote controller 100 transmits the speech to the control device 200. Also, the remote controller 100 may analyze the speech and transmit its features to the control device 200. If the input information is button input, the remote controller 100 may convert the button input into an infrared signal or an RF signal, and transmit the converted signal to the control device 200.

In this case, a process is used for recognizing a control command, which is a complex input of the speech from the user and the button. Based on reference information, the control device 200 recognizes the user input information transmitted from the remote controller 100 to be a predetermined control command. The reference information will be described in detail with reference to FIG. 2.

The control device 200 generates a control signal according to the recognized control command, and transmits the generated control signal to the controlled device 300. The controlled device 300 operates according to the control signal.

The controlled device 300 may be an electronic appliance such as a TV set, DVD player, air conditioner, or audio system. Although the control system of the embodiments of the present invention includes only one controlled device 300, the present invention is not limited thereto, and a control system including a plurality of controlled devices should be considered as another embodiment of the present invention.

The control device 200 may be formed in the body of the remote controller 100 or the controlled device 300. However, as illustrated in FIG. 1, according to an aspect of the present invention the control device 200 can be a separate device. For example, the control device 200 may be a home server that manages controlled devices that constitute a home network. Accordingly, in the following embodiments of the present invention, it is exemplified that the control device 200 exists as a separate device from the remote controller 100 and the controlled device 300.

The control device 200 according to an embodiment of the present invention will be explained with reference to FIG. 2.

Figure 2:
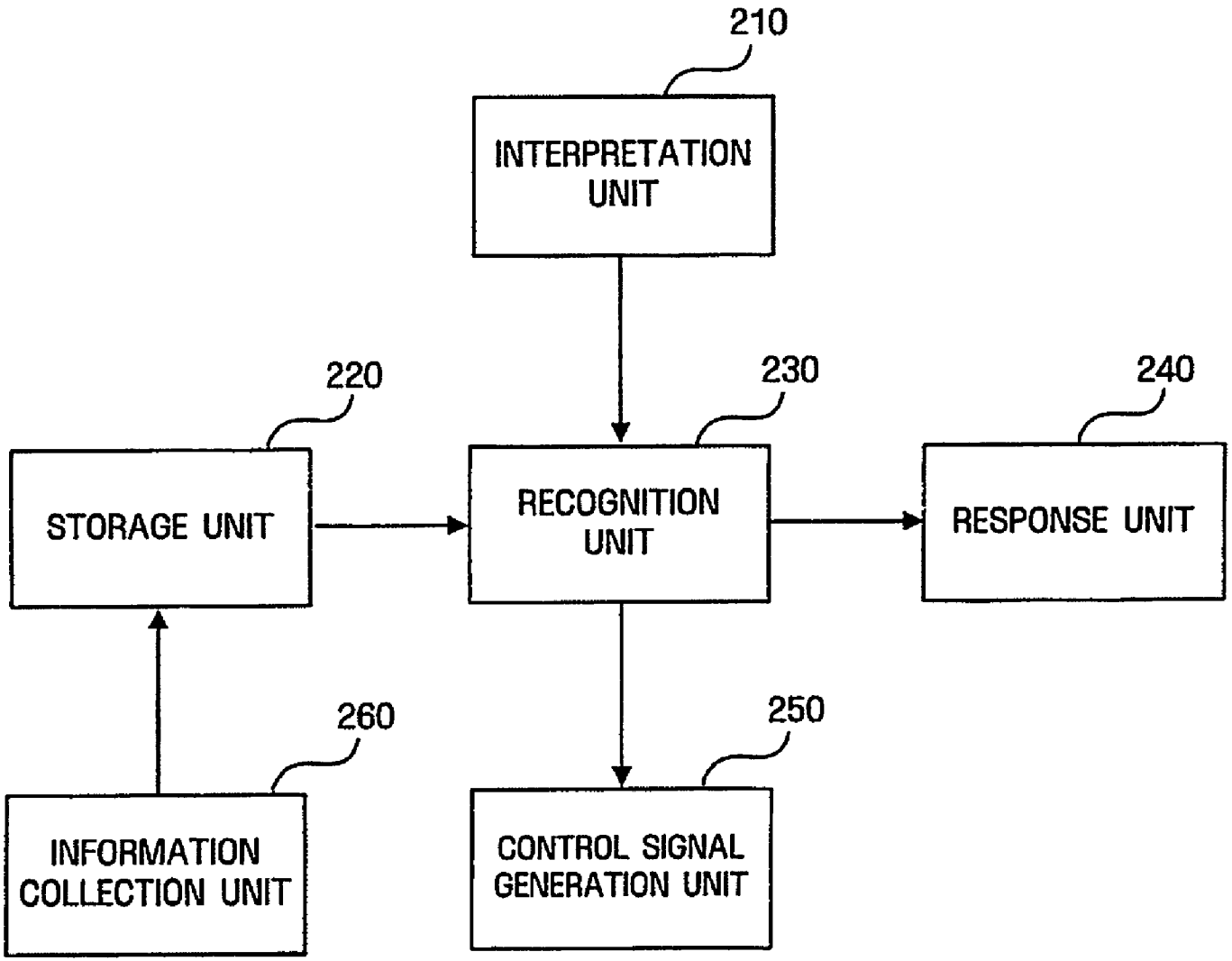
FIG. 2 is a block diagram illustrating the construction of a control device according to an exemplary embodiment of the present invention.

FIG. 2 is a block diagram illustrating the control device according to an exemplary embodiment of the present invention.

The control device 200 includes an interpretation unit 210, a storage unit 220, a recognition unit 230, a response unit 240, a control signal generation unit 250 and an information collection unit 260.

The interpretation unit 210 interprets input information transmitted from the remote controller 100 and converts the interpreted information into a signal that can be processed by the recognition unit 230. For example, if a user presses a numeral button "1" of the remote controller 100, the remote controller 100 outputs an infrared or RF signal that is mapped to the numeral button "1." If the signal outputted from the remote controller 100 is received, the interpretation unit 210 interprets that the received signal means the numeral "1," and outputs an electric signal corresponding to the numeral "1" to the recognition unit 230.

If the user inputs information using speech, the remote controller 100 outputs the speech inputted from the user. If the output signal is received, the interpretation unit 210 analyzes the speech and recognizes it through its features. The interpretation unit 210 outputs to the recognition unit 230 an electric signal that is mapped to the recognized speech. In the case where the remote controller 100 analyzes the speech and transmits its features, the process of analyzing the speech through the interpretation unit 210 can be omitted.

The storage unit 220 stores the reference information; an example of the reference information is illustrated in FIG. 3. The reference information includes information on control objects, information on effective input values for the respective control objects, and information on control commands mapped to input information formed by the effective input values. The reference information may further include status information, information on effective input values for the respective status information, and information on the control commands mapped to input information formed by the effective input values.

The information on the control objects indicates controlled devices such as a TV, an air conditioner, or functions of the controlled devices such as volume adjustment, temperature adjustment, and sleep timer.

The status information indicates an operation state of the controlled device. For example, the status information may indicate an on/off state of the controlled device, whether a TV is performing a dual screen function, whether a DVD player is playing a moving picture, and others.

The information on effective input values indicates status information or proper input values for control objects.

The information on control commands details the control command, status information and effective input values. For example, the reference information as illustrated in FIG. 3 indicates that the numeral inputted in a state where the control object is an air conditioner can be recognized as a temperature adjustment command.

The recognition unit 230 recognizes the control command; in order to recognize the control command, the recognition unit 230 refers to the reference information stored in the storage unit 220.

The recognition unit 230 confirms a control object, to which a command focus is presently set, and extracts a control command from the reference information. The command focus indicates for which control object the control work is performed. The control object may be a controlled device or a function of the controlled device. The recognition of the control command according to the control object, to which the command focus is set according to embodiments of the present invention, will be explained with reference to FIGS. 4 and 5.

If the control object is the controlled device, the recognition unit 230 can judge which controlled device the input information refers to through the command focus. For example, if the input information is "volume up/down" in a state where the reference information as illustrated in FIG. 4 is stored in the storage unit 220, the recognition unit 230 confirms the set control object to which the command focus is presently set. If the set control object is a TV, the recognition unit 230 can recognize the input information as a TV volume level control command. If the control object, to which the command focus is set, is an audio system in a state where the same information is inputted, the recognition 230 can recognize the input information as a volume level control command of the audio system.

If the control object refers to a function of the controlled device, the recognition unit 230 can judge which function the input control command is to control through the command focus. For example, if the control object, to which the command focus is set, is a volume level in the case where the reference information as illustrated in FIG. 5 is stored in the storage unit 220, and the numeral "11" is inputted as the input information, the recognition unit 230 can recognize the input information as a TV volume level control command. If the control object, to which the command focus is set, is a lock function in a state where the same control command is inputted, the recognition unit 230 can recognize the input information as a password for accessing classified information.

On the other hand, if the control command cannot be correctly recognized by the information on the control object to which the command focus is presently set, or if there is no command focus presently set, the recognition unit 230 can recognize the control command by referring to the status information; the recognition of the control command by referring to status information according to embodiments of the present invention will be explained with reference to FIGS. 6 and 7.

If the reference information as illustrated in FIG. 6 is stored in the storage unit 20 and a numeral "20" is input as the input information, the recognition unit 230 confirms the control object, to which the command focus is set. However, if there is no control object to which the command focus is presently set, the recognition unit 230 confirms the status information of the controlled unit. If the status information indicates that power is being supplied to a TV, the recognition unit 230 can recognize the input information as a TV channel selection command. If the status information indicates that power is being supplied to an air conditioner in a state where there is no control object to which the command focus is presently set and the same information is inputted, the recognition unit 230 can recognize the input information as a temperature control command of the air conditioner.

According to another embodiment of the present invention, although there is a control object to which the command focus is set, the recognition unit 230 can recognize the input information by referring to the status information. For example, if the reference information as illustrated in FIG. 7 is stored in the storage unit 220 and "channel up/down" is inputted, the recognition unit 230 confirms the control object, to which the command focus is set, in order to recognize the control command. As a result of confirmation, if the control object is a dual-screen function, the recognition unit 230 cannot determine whether the input information refers to a main picture or a sub-picture. At this time, the recognition unit 230 can refer to the status information. If the status information indicates that the main picture is allocated to a DVD player and the sub-picture is allocated to a TV, the recognition unit 230 can recognize the input information as a channel control command for the sub-picture with reference to the reference information (e.g., the reference information illustrated in FIG. 7) stored in the storage unit 220.

In the process of recognizing the control command, the recognition unit 230 judges whether an input value is an effective input value for the control object, to which the command focus is set, or the status information. This process will be explained in detail with reference to FIG. 8.

If the numeral "11" is inputted as the input information in a state where the reference information as illustrated in FIG. 8 is stored in the storage unit 220, the input unit 220 confirms the control object to which the command focus is set. If the control object is set to a sleep timer function, the recognition unit 230 recognizes the input information as a command for setting a sleep timer with reference to the reference information as illustrated in FIG. 8. However, if the effective input value information of the reference information is set in intervals of thirty (e.g., 0, 30, 60, and 90) as illustrated in FIG. 8, the recognition unit 230 cannot recognize the control command. In this case, the recognition unit 230 may output information to the response unit 240 that the input value is not effective.

On the other hand, if the input information is found not suitable for the presently set command focus or the status information as the result of comparing the effective input value information with the input value that constitutes the input information, the recognition unit 230 may also extract a new command focus through the corresponding input information. For example, if the information inputted by the user is a speech input of "air conditioner" in a state where the reference information as illustrated in FIG. 8 is stored in the storage unit 220, and the control object, to which the command focus is set, is a sleep timer function, the speech input is not suitable for the sleep timer function. In this case, the recognition unit 230 cannot recognize the control command that the input information means.

However, if the control object corresponding to the speech input of "air conditioner" is one of a plurality of controlled devices, the recognition unit 230 resets the command focus to the air conditioner. At this time, the recognition unit 230 preferentially judges the control command subsequently inputted as the control command for the air conditioner.

As illustrated in FIG. 9, information on the control objects recognizable through the input information may be stored in the storage unit 220. The recognition unit 230 extracts the command focus from the user input information interpreted by the interpretation unit 210 with reference to the stored information. Quotation marks (" ") in an input information section as illustrated in FIG. 9 indicate a speech command. Referring to the illustrated information, when the speech input of "volume" is inputted, the recognition unit 230 can set the command focus to a volume adjustment function that is the control object mapped to the "volume" speech input.

Accordingly, the control object, to which the command focus is set, can be dynamically changed according to a user controlled process, and the information on which control object the command focus is presently set to may be stored in the storage unit 220.

The recognition unit 230 extracts the recognized control command with reference to the reference information and transfers the extracted control command to the control signal generation unit 250.

The response unit 240 outputs the result recognized by the recognition unit 230 to the user visually and aurally through a display unit (not shown) and a speaker unit (not shown). That is, even if the recognition unit 230 cannot recognize which control command the input information refers to, the response unit 240 can inform the user that the control command indicated by the presently input information has not been recognized. Also, if the recognition unit 230 recognizes the control command, the response unit 240 can inform the user of the recognition results (e.g., information that the input information has been recognized as a volume control command, or information that the present command focus is set to the volume control function through the input information).

The control signal generation unit 250 generates a control signal according to the control command transmitted from the recognition unit 230 to output the generated control signal to the controlled device, so that the controlled device can be controlled according to the user input information.

The information collection unit 260 is connected with each controlled device to collect status information of each controlled device. The status information collected by the information collection unit 260 may be stored in the storage unit 220.

Hereinafter, the operation of the control device according to an embodiment of the present invention will be explained in detail with reference to FIGS. 10 to 12.

Figure 10:
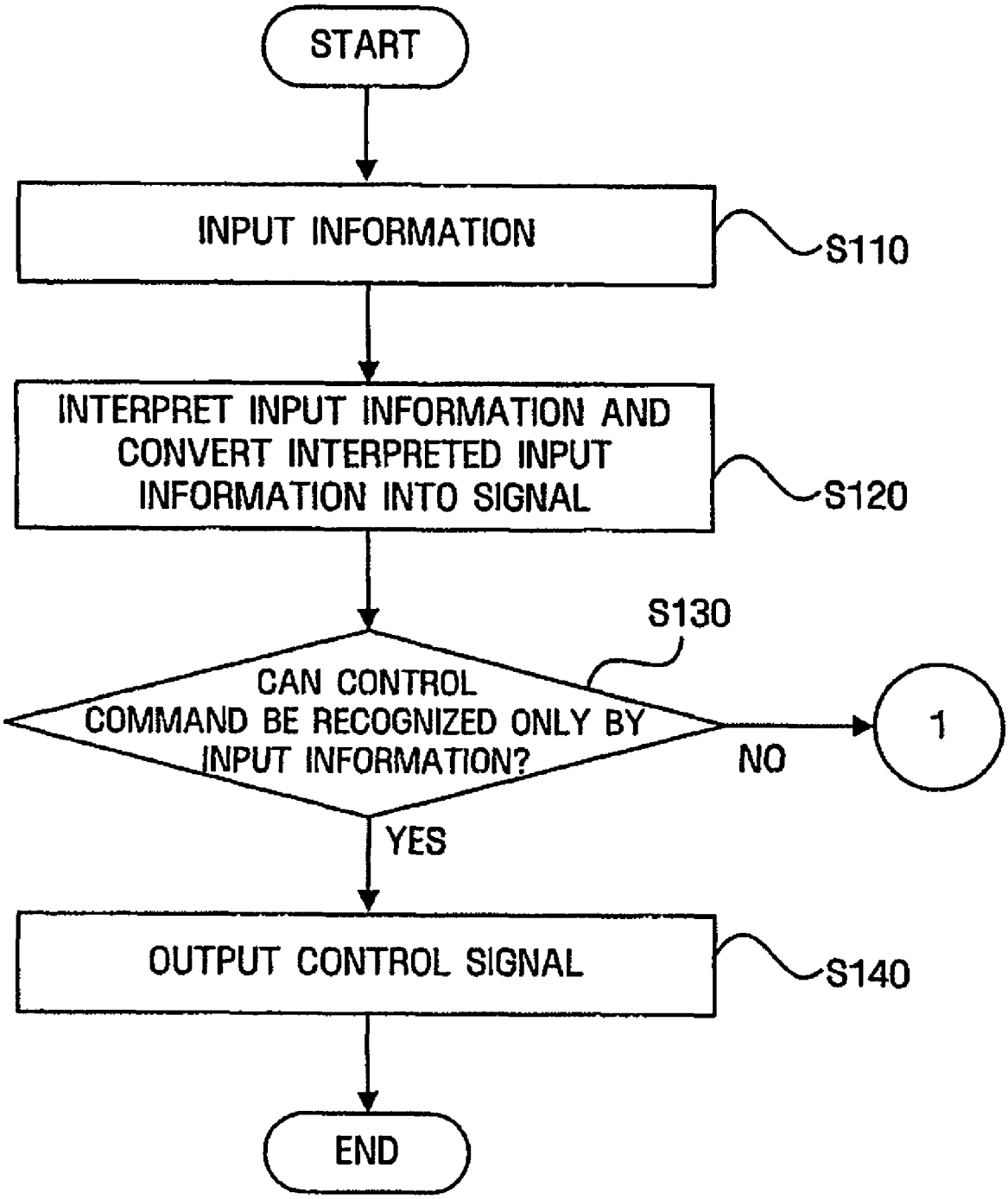
FIG. 10 is a flowchart illustrating a process of recognizing a control command according to an exemplary embodiment of the present invention.

FIG. 10 is a flowchart illustrating a control command recognition process according to an exemplary embodiment of the present invention.

If the input information is inputted from the user S110, the interpretation unit 210 interprets the input information and converts the interpreted input information into a signal that can be processed by the recognition unit 230 S120.

Then, the recognition unit 230 recognizes the control command. If the recognition unit 230 can recognize the control command without referring to the reference information S130, the control signal generation unit 250 generates a control signal according to the control command recognized by the recognition unit 230 and outputs the generated control signal to the controlled device S140.

In S130, the control command can be recognized without referring to the reference information when the number of controlled devices or the number of functions of the controlled device is small. For example, if the input information corresponds to a power on/off button of the remote controller in a state where the number of controlled devices that can be controlled through the control device is one, the recognition unit 230 can recognize the control command even without referring to the reference information.

In S130, the control command can be recognized without referring to the reference information if a function button for controlling a predetermined controlled device is provided on the remote controller. For example, if the input information is inputted by a multi-lingual button that is provided on the remote controller for controlling a TV multi-lingual function, the recognition unit 230 can recognize the user's control intention by the control command without referring to the reference information.

In this case, the controlled device can be controlled by the conventional method.

On the other hand, if the control command cannot be recognized via the input information in S130, the recognition unit can refer to the reference information; this case will be explained with reference to FIG. 11.

Figure 11:
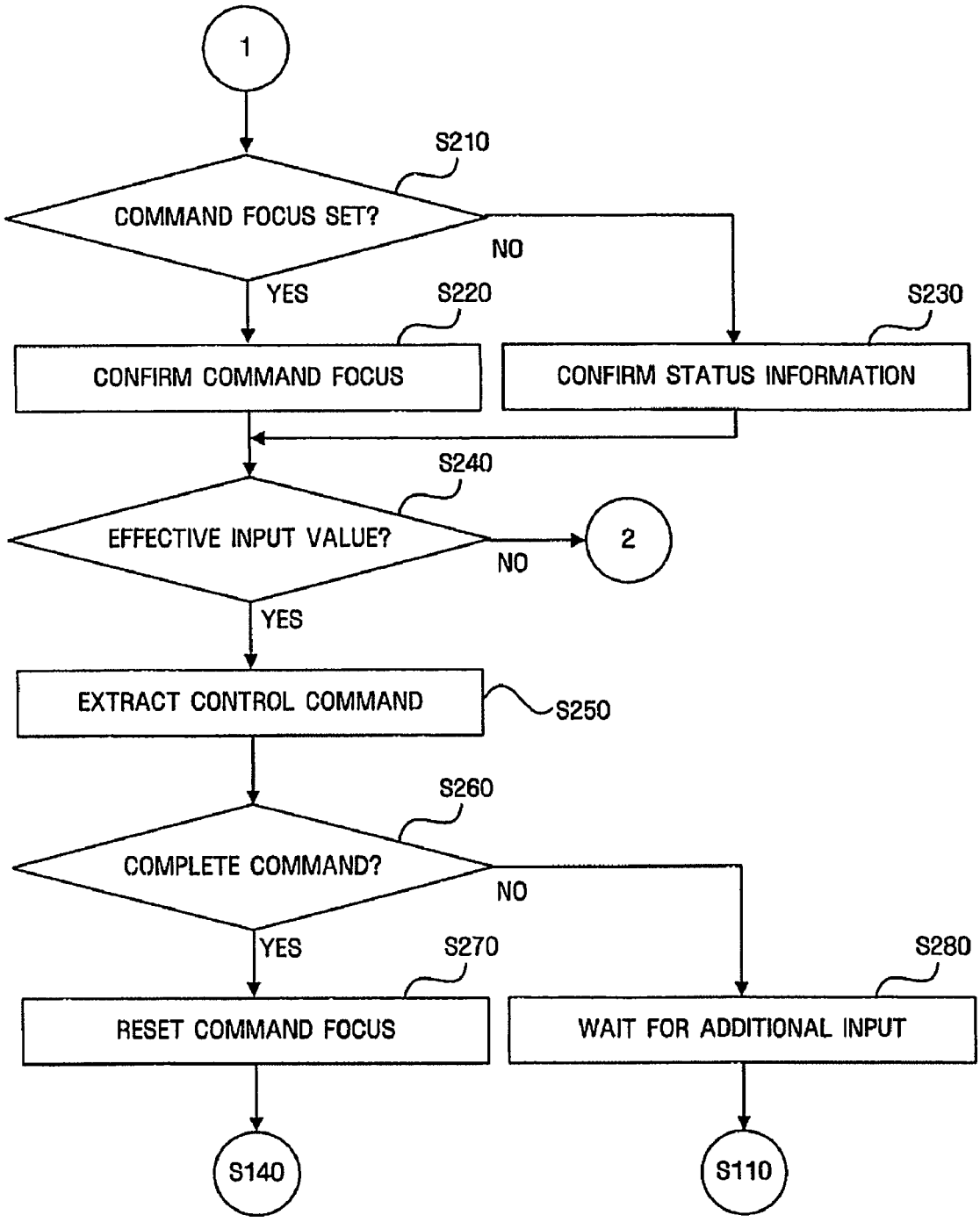
FIG. 11 is a flowchart illustrating a process of recognizing a control command according to another embodiment of the present invention.

FIG. 11 is a flowchart illustrating a control command recognition process according to another embodiment of the present invention.

If the control command cannot be recognized only via the input information in S130 of FIG. 10, the recognition unit 230 judges whether there is a control object to which the command focus is presently set S210.

If the command focus is set to a predetermined control object, the recognition unit 230 confirms the control object in order to recognize the control command S220.

Then, the recognition unit 230 judges whether the input information has an effective input value for the control object, to which the command focus is presently set, with reference to the reference information stored in the storage unit 220 S240.

If the input information has an effective input value for the control object, the recognition unit 230 extracts the control object through the reference information and the control command mapped to the input information S250.

If the command focus is not set as the result of judgment in S210, the recognition unit 230 confirms the status information S230.

Then, the recognition unit 230 judges, using the reference information, whether the input information has an effective input value for the status information S240. If the input information has the effective input value, the recognition unit 230 extracts the confirmed status information and the control command mapped to the input information with reference to the reference information S250.

If a complete control command cannot be constructed by the input values that constitute the input information S260, the recognition unit 230 waits for an additional input S280. For example, if the command focus is set to a locking function and the input information corresponds to the numeral "11," the recognition unit 230 can recognize the input information as a password with reference to the reference information. However, if a password required for the locking function corresponds to a four digit number, the recognition unit 230 waits for the input of the remaining two figures in a state where the input information (i.e., the numeral "11") is stored.

However, if as the result of judgment in S260 the input value is complete, the recognition unit 230 can set a new command focus according to the extracted control command with reference to the reference information S270. Then, the control signal generation unit 250 generates a control signal according to the control command extracted by the recognition unit 230 and outputs the generated control signal to the controlled device S140.

On the other hand, if the input value constituting the input information does not correspond to an effective input value for the control object confirmed in S220 or the status information confirmed in S230, the recognition unit 230 can set the command focus for the control object mapped to the input information.

Figure 12:
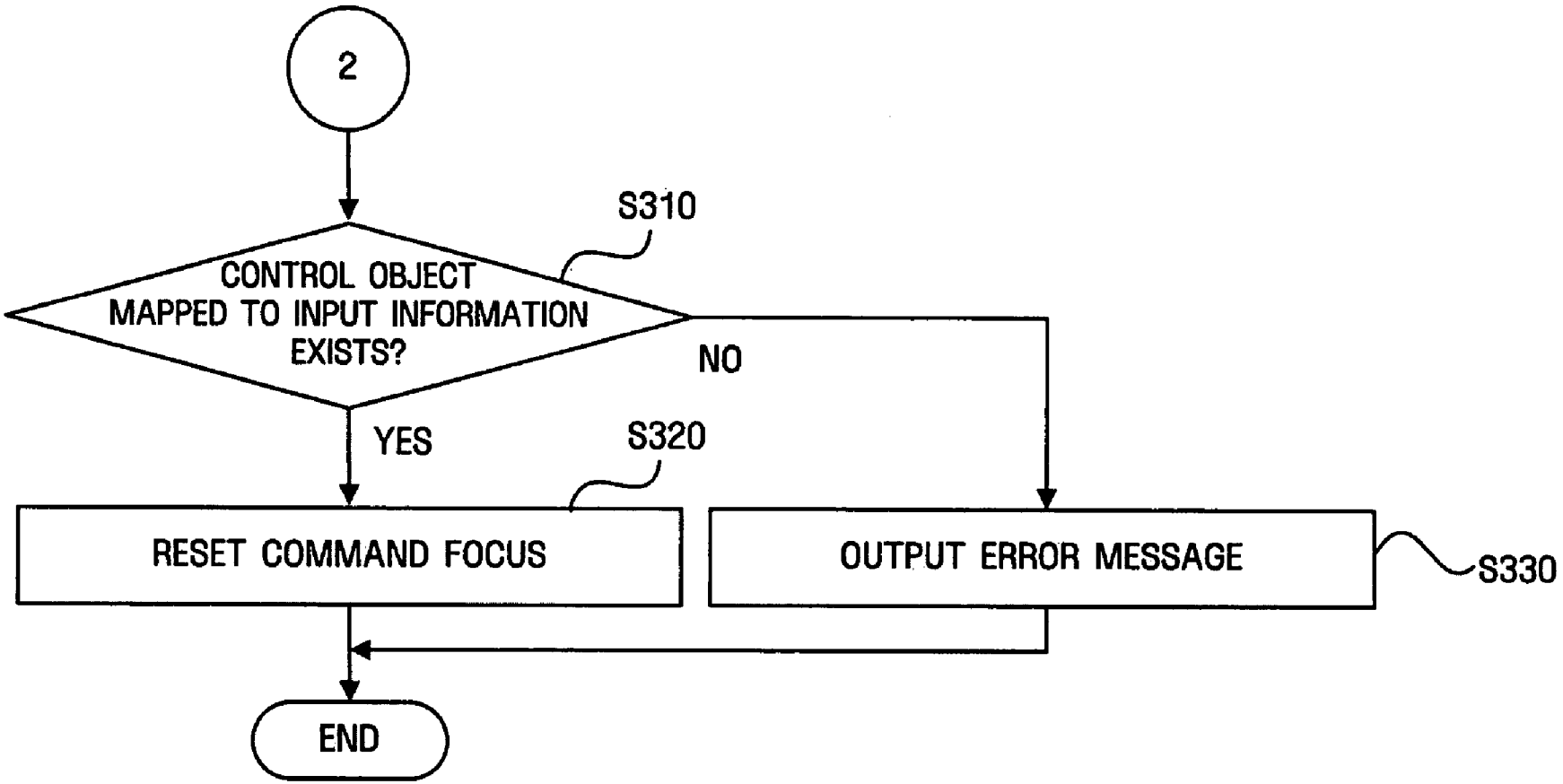
FIG. 12 is a flowchart illustrating a process of recognizing a control command according to still another embodiment of the present invention.

FIG. 12 is a flowchart illustrating a control command recognition process according to still another embodiment of the present invention.

Referring to FIG. 12, if the input value constituting the input information does not correspond to an effective input value for the control object confirmed in S240 or the status information confirmed in S220, the recognition unit 230 judges whether there is a control object mapped to the input value constituting the input information S310. This judgment can be performed by searching for the same information as explained with reference to FIG. 9.

If a control object mapped to the input value constituting the input information exists, the recognition unit 230 resets the command focus to the control object S320.

However, if the control object does not exist, the recognition unit 230 outputs the information to the user through the response unit 240 that the input value is not effective S330.

Since the command focus may be set through the speech input or the button input for the same menu navigation, the process of S310 and S320 can be omitted in the case where the control command is inputted through the button input.

Hereinafter, the control command recognizing process as described above will be explained in detail with reference to FIGS. 3 and 13.

FIG. 13 is a view illustrating information on control objects recognizable through input information according to another embodiment of the present invention.

If the information illustrated in FIGS. 3 and 13 is stored in the storage unit 220, the recognition unit 230 recognizes the control command with reference to the stored information.

If the command focus is initially set to an air conditioner, the control device recognizes the input information from the user as the control command for controlling the air conditioner. For example, if the input information is a number, it is an effective input value for the presently set command focus. Accordingly, the recognition unit 230 recognizes the input information as a temperature control command of the air conditioner, and the control signal generation unit 250 generates and outputs a temperature control signal to the air conditioner.

If a speech input of "TV" is inputted in the process of controlling the air conditioner, the recognition unit 230 judges whether the input information has an input value suitable for the presently set command focus. As illustrated in FIG. 3, since inputs except for a number are improper input values for the case where the command focus is set to the air conditioner, the recognition unit 230 cannot recognize the input information as an air conditioner control command. At this time, the recognition unit 230 extracts the command focus from the input information through the information illustrated in FIG. 13.

According to the information illustrated in FIG. 13, since the command focus can be set to a TV through the speech input of "TV", the recognition unit 230 resets the command focus to TV. The recognition unit 230 can preferentially recognize the input control command as a control command for controlling the TV. Accordingly, if a number is inputted as the control command, which is an effective value, in the case where the command focus is set to TV with reference to FIG. 3, the recognition unit 230 recognizes the input information as a TV channel control command.

Then, if the user inputs a speech input of "sleep timer," the recognition unit 230 judges whether the speech input is an effective input value for the command focus. As illustrated in FIG. 3, the speech input of "sleep timer" is not the effective input value, and thus the recognition unit 230 sets the command focus to the control object mapped to the input information with reference to FIG. 13. According to FIG. 13, the input value of "sleep timer" is mapped to a TV sleep timer function, and thus the recognition unit 230 resets the command focus to the TV sleep timer function.

If the user inputs the numeral "11" in a state where the command focus is set to the sleep timer, the recognition unit 230 cannot recognize the input information as a time setting command for the sleep timer since an effective value in a state where the command focus is set to the sleep timer is a number that is a multiple of thirty, for example (see FIG. 3). Also, referring to FIG. 13, there is no command focus that can be simply extracted for the input value of the numeral "11," and thus the recognition unit 230 cannot recognize the control command. In this case, the response unit 240 outputs to the user the information stating that the input value is not effective. If a number that is a multiple of 30 is inputted and the sleep timer set is successfully completed, the command focus may be set again to a TV or no command focus may be set.

On the other hand, if a power-off command is inputted in a state where the command focus is set to a TV, the recognition unit 230 recognizes this as a TV power-off command. At this time, the control signal generation unit 240 generates and outputs the TV power-off signal and cuts off the power supply to the TV. If the power supply to the TV is cut off, the command focus set to the TV may be removed. In this case, if the user inputs a numeral as the input information, the recognition unit 230 refers to the status information since there is no presently set command focus. According to FIG. 3, if a numeral is inputted as the control command in the case where the power is supplied to the air conditioner even if the presently set command focus does not exist, the numeral can be recognized as the temperature control command for the air conditioner. Accordingly, the recognition unit 230 recognizes the input numeral as the temperature control command of the air conditioner. While the control process for the controlled device according to the recognition of the control command is performed, the status information of each controlled device is collected by the information collection unit 260 and is stored in the storage unit 220. Moreover, whenever the command focus is reset, the recognition unit 230 can store which control object the reset command focus is set to.

In the embodiment of the present invention, the recognition process has been described with reference to FIGS. 3 and 13. However, the present invention is not limited thereto, but diverse embodiments become possible by combining the command focus, status information and information on whether the input value is effective.

As described above, the control command recognizing method and control device using the same according to the present invention can heighten the recognition rate of the control command inputted through a complex use of the speech and buttons.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of a control system for recognizing a control command for a control system, comprising:

receiving, by the control system, input information;

checking, by the control system, a control object to determine whether a command focus is set from control objects;

extracting, by the control system, a control command, which is mapped on the control object, to which the command focus is set, and the input information, with reference to predetermined reference information; and outputting, by the control system, a control signal to control the control object according to the extracted control command, wherein if there is no control object to which a command focus is set, the method further comprises: confirming status information indicative of an operation status of a controlled device; extracting the control command mapped to the confirmed status information and the input information with reference to the reference information; and outputting the control signal according to the extracted control command;

wherein the reference information includes the status information, information on the effective input value for the status information, and information on the control command mapped to the input information formed by the effective input value;

wherein if the input information includes an ineffective value for the status information, the method further comprises: extracting the control object from the input information; and setting the command focus for the extracted control object.

2. The method as claimed in claim 1, wherein the predetermined reference information includes information on the control object, information on an effective input value for the control object and information on a control command mapped to the input information formed by the effective input value.

3. The method as claimed in claim 2, wherein if the input information includes an ineffective input value for the control object, the method further comprises:

extracting the control object mapped to the input information; and setting the command focus for the extracted control object.

4. The method as claimed in claim 1, wherein the control object is a controlled device or a function of the controlled device.

5. The method as claimed in claim 1, wherein the input information is speech input or a button input produced by the user.

6. A control device comprising:

a recognition unit to check a control object to determine whether a command focus is set and to extract a control command, which is mapped to a control object which the command focus is set, and input information, with reference to predetermined reference information if the control object exists; and a control signal generation unit to generate a control signal based on the extracted control command;

wherein if there is no control object to which a command focus is set, the recognition unit confirms the status information indicative of an operation status of a controlled device, and extracts the control command mapped to the confirmed status information and the input information with reference to the reference information; and the control signal generation unit outputs the control signal according to the extracted control command;

wherein the reference information includes the status information, information on the effective input value for the status information, and information on the control command mapped to the input information formed by the effective input value;

wherein if the input information includes an ineffective value for the status information, the recognition unit extracts the control object from the input information, and sets the command focus for the extracted control object.

7. The control device as claimed in claim 6, wherein the predetermined reference information includes information on the control object, information on an effective input value for the control object and information on a control command mapped to the input information formed by the effective input value.

8. The control device as claimed in claim 7, wherein if the input information includes an ineffective input value for the control object, the recognition unit extracts the control object mapped to the input information, and sets the command focus for the extracted control object.

9. The control device as claimed in claim 6, wherein the control object is a controlled device or a function of the controlled device.

10. The control device as claimed in claim 6, wherein the input information is speech input or a button input produced by the user.

11. The control device as claimed in claim 6, further comprising:

a storage unit to store reference information.

12. The control device as claimed in claim 6, further comprising:

an interpretation unit to interpret input information.

13. The control device as claimed in claim 6, further comprising:

a response unit to output video and/or audio information.

14. The control device as claimed in claim 6, further comprising:

an information collection unit to collect status information.

* * * * *